US008290410B2

(12) United States Patent
Lee et al.

(10) Patent No.: US 8,290,410 B2
(45) Date of Patent: Oct. 16, 2012

(54) DEVELOPING UNIT OF IMAGE FORMING APPARATUS

(75) Inventors: Jong Woo Lee, Suwon-si (KR); Yong Hoon Lee, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 435 days.

(21) Appl. No.: 12/617,281

(22) Filed: Nov. 12, 2009

(65) Prior Publication Data

US 2010/0135701 A1 Jun. 3, 2010

(30) Foreign Application Priority Data

Dec. 1, 2008 (KR) ..... 10-2008-0120558

(51) Int. Cl.
*G03G 15/08* (2006.01)

(52) U.S. Cl. ..... 399/284

(58) Field of Classification Search ..... 399/284
See application file for complete search history.

(56) References Cited

U.S. PATENT DOCUMENTS 6,212,343 B1 * 4/2001 Hosokawa et al. ..... 399/102
2005/0111888 A1 * 5/2005 Kim ..... 399/284

FOREIGN PATENT DOCUMENTS

JP 07-013411 1/1995
JP 11-272107 10/1999

OTHER PUBLICATIONS

English language abstract of JP 07-013411, published Jan. 17, 1995.
Machine English language translation of JP 07-013411, published Jan. 17, 1995.
English language abstract of JP 11-272107, published Oct. 8, 1999.
Machine English language translation of JP 11-272107, published Oct. 8, 1999.

* cited by examiner

*Primary Examiner* — David Gray
*Assistant Examiner* — Andrew Do
(74) *Attorney, Agent, or Firm* — Stanzione & Kim, LLP

(57) ABSTRACT

A developing unit provided in an image forming apparatus includes a regulating member that improves developer layer regulation performance. The developing unit is configured to feed developer to a photoconductor, on which an electrostatic latent image is formed, to form an image. The regulating member of the developing unit includes a bending portion contacting an outer peripheral surface of a developing device provided in a frame of the developing unit. The width of the regulating member is variable to increase rearward from the bending portion. The regulating member may further include an extension portion extending from the bending portion. Sealing members may be attached to both ends of the frame of the developing unit so as to contact the respective ends of the bending portion.

19 Claims, 11 Drawing Sheets

DEVELOPING UNIT OF IMAGE FORMING APPARATUS

CROSS-REFERENCE TO RELATED APPLICATION(S)

This application claims the benefit of Korean Patent Application No. 2008-0120558, filed on Dec. 1, 2008 in the Korean Intellectual Property Office, the disclosure of which is incorporated herein by reference in its entirety.

TECHNICAL FIELD

The present disclosure relates generally to an image forming apparatus, and, more particularly, to an image forming apparatus having improved developer thickness regulation.

BACKGROUND OF RELATED ART

Image forming apparatuses are generally devised to form an image on a printing medium according to input signals. Examples of image forming apparatuses include printers, copiers, facsimiles, devices combining some of the functions thereof, and the like An electro-photographic image forming apparatus as a kind of image forming apparatus may include a photoconductor, upon a surface of which an electrostatic latent image is formed by a light scanning unit, and a developing unit to develop the electrostatic latent image into a visible image by applying developer to the electrostatic latent image. The visible image, formed on the photoconductor, may be transferred to a printing medium directly or by way of an intermediate transfer unit, and thereafter may be fixed to the printing medium via a fixing process.

The developing unit may include a developing device arranged longitudinally parallel to the photoconductor and may be configured to attach an amount of developer to the photoconductor. A regulating member configured to regulate a layer height of the developer may be attached to an outer periphery of the developing device.

As the developing operations proceed, some of the developer attached to the developing device may be removed from the developing device by the regulating member, and may tend to accumulate near the end portions of the regulating member, thereby applying a gradually increasing pressure to the ends of the regulating member. This may cause leakage of the developer between the regulating member and a sealing member. When the leaked developer is solidified upon receiving heat and pressure applied thereto, the developer may act to press the regulating member toward the sealing member, resulting in deformation of the regulating member. The deformed regulating member cannot effectively regulate a layer of the developer on the developing device, thus having a negative effect on the quality of a printed image. Since the solidified developer may adhere near the ends of the regulating member, the developer attached to both side ends of the developing device may have an increased height, having a risk of contamination of a non-imaging area due to the additional developer. Thus an image forming apparatus with an improved configuration of regulating member thus is desired.

SUMMARY OF DISCLOSURE

In accordance with an aspect of the present disclosure, a developing unit usable in an image forming apparatus for developing an electrostatic latent image on a photoconductor may be provided to comprise a frame, a developing device and a regulating member. The frame may define therein a developer receiving chamber for storing developer. The developing device may be rotatably provided in the frame, and may be configured to feed the developer to the photoconductor. The regulating member may be configured to regulate a developer layer attached to the developing device, and may have a bending portion configured to contact an outer peripheral surface of the developing device. The regulating member may have a variable width that increases as moving rearward away from the bending portion.

The developing unit may further comprise sealing members disposed at locations on the frame such that each widthwise ends of the bending portion comes into contact with a respective corresponding one of the sealing members.

The contact width between the regulating member and the sealing member at either widthwise end of the bending portion may be less than or equal to one half of the entire width of the sealing member.

The contact width between the regulating member and the sealing member may increase as moving rearward away from the bending portion.

The regulating member may further comprise an extension portion extending from the bending portion.

The developing unit may further comprise sealing members disposed at locations on the frame such that each of widthwise ends of the extension portion is spaced apart from a respective corresponding one of the sealing members by a distance.

The distance by which each widthwise end of the extension portion is spaced apart from the respective corresponding one of the sealing members may be about two times or more of the contact width between the bending portion and the sealing member.

The developing unit may further comprise sealing members disposed at end portions of the frame. The extension portion may have one or more developer discharge holes formed on each widthwise end thereof, each widthwise end of the extension portion being adjacent to a respective corresponding one of the sealing members.

The developing unit may further comprise a supporting member fixed to the frame. The regulating member may be attached to the supporting member using an adhesive or via welding.

The regulating member may comprise at least one material selected from Steel Use Stainless (SUS), phosphorus bronze, brass, polyimide and polyamide.

The regulating member may have a thickness in the range of about 0.05 mm to about 1.5 mm.

According to another aspect of the present disclosure, a regulating device configured to regulate a developer layer on a developing device that is configured to feed developer to a photoconductor of an image forming apparatus may be provided to include a regulating member and a supporting member. The regulating member may have a bending portion configured to come into contact with an outer peripheral surface of the developing device. The supporting member may be configured to support a supporting end of the regulating member away from the bending portion. The regulating member may have a variable width that increases as moving rearward away from the bending portion toward the supporting end.

According to yet another aspect of the present disclosure, a regulating device may be provided for regulating a developer layer on a developing device of a developing unit. The developing unit may include a frame in which a developer receiving chamber is defined, the developing device rotatably provided in the frame for feeding developer to a photoconductor and sealing members disposed on both ends of the frame. The regulating device may comprise a regulating member having a bending portion configured to come into a contact with an outer peripheral surface of the developing device. Both ends of the bending portion may contact the sealing members of the developing unit. The regulating member may have a variable width that increases as moving rearward away from the bending portion.

The contact width between the regulating member and the sealing member at either end of the bending portion may be less than or equal to one half of the entire width of the sealing member.

The contact width between the regulating member and the sealing member may increase as moving rearward away from the bending portion so as to be greater than one half of the entire width of the sealing member at a location on the regulating member away from the bending portion.

According to even yet another aspect of the present disclosure, developing unit usable in an image forming apparatus for developing an electrostatic latent image on a photoconductor may be provided to comprise a developing device and a regulating member. The developing device may be configured to rotate about a rotational axis, and may have a surface for supporting thereon a layer of developer. The regulating member may have a bending portion in pressing relationship with the surface of the developing device so as to regulate a thickness of the layer of developer being supported on the surface of the developing device. The regulating member may have a variable width along a direction parallel to the rotational axis of the developing device such that the bending portion has a first width while a portion of the regulating member away from the bending portion has a second width wider than the first width.

The regulating member may further comprise an extension portion extending from the bending portion and having a third width narrower than the first width.

The developing unit may further comprise a sealing member disposed adjacent at least one widthwise end of the regulating member. The sealing member may be in contact with the at least one widthwise end of the regulating member, and may be spaced apart from a corresponding widthwise end of the extension portion.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION

Figure 1:
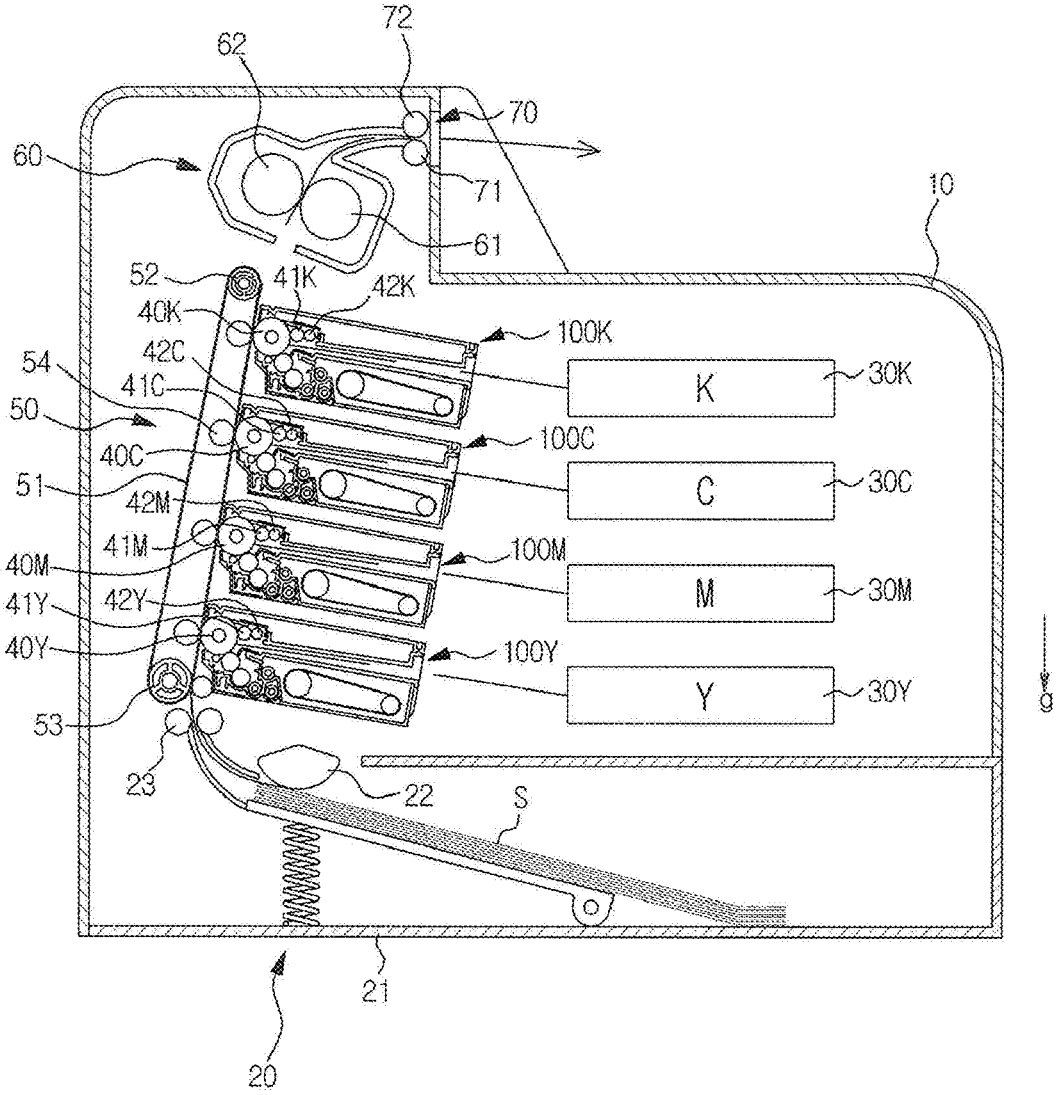
FIG. 1 is a sectional view illustrating an image forming apparatus in accordance with an embodiment.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

With reference to FIG. 1, a sectional view of an image forming apparatus in accordance with an embodiment is illustrated.

The image forming apparatus may include a body 10, a printing medium supply unit 20, light scanning units 30Y, 30M, 30C and 30K, photoconductors 40Y, 40M, 40C and 40K, developing units 100Y, 100M, 100C and 100K, a transfer unit 50, a fixing unit 60 and a printing medium discharge unit 70.

The body 10 may define an exterior of the image forming apparatus, and may support a variety of constituent elements installed therein.

The printing medium supply unit 20 may include a cassette 21 in which printing media S is stored, a pickup roller 22 configured to pick up the printing media S stored in the cassette 21 sheet by sheet and a delivery roller 23 configured to deliver the picked-up printing medium S toward the transfer unit 50.

The light scanning units 30Y, 30M, 30C and 30K may be configured to scan light, corresponding to image information of yellow (Y), magenta (M), cyan (C) and black (K) colors, to the photoconductors 40Y, 40M, 40C and 40K based on print signals.

The photoconductors 40Y, 40M, 40C and 40K may be charged with a predetermined electrical potential by charging devices 41Y, 41M, 41C and 41K before light is scanned from the light scanning units 30Y, 30M, 30C and 30K. With the light scanned from the light scanning units 30Y, 30M, 30C and 30K, electrostatic latent images may be formed on surfaces of the respective photoconductors 40Y, 40M, 40C and 40K. Reference numerals 42Y, 42M, 42C and 42K indicate cleaning devices configured to clean the charging devices 41Y, 41M, 41C and 41K.

The developing units 100Y, 100M, 100C and 100K may be configured to feed different colors of developers, for example, yellow (Y), magenta (M), cyan (C) and black (K) developers, to the corresponding photoconductors 40Y, 40M, 40C and 40K to form visible images on the surfaces of the respective photoconductors 40Y, 40M, 40C and 40K.

The transfer unit 50 may include a paper delivery belt 51, configured to be driven by a driving roller 52 and a driven roller 53, and a plurality of transfer rollers 54 located inside the paper delivery belt 51. The transfer rollers 54 may be arranged to oppose respective photoconductors 40Y, 40M, 40C and 40K, and may function to transfer the developer on the photoconductors 40Y, 40M, 40C and 40K onto the printing medium S, such as, e.g., paper.

The fixing unit 60 may includes a heating roller 61 having a heater and a press roller 62 arranged oppose the heating roller 61. When the printing medium S passes between the heating roller 61 and the press roller 62, an image may be fixed to the printing medium S by heat transmitted from the heating roller 61 and the pressure acting between the heating roller 61 and the press roller 62.

The printing medium discharge unit 70 may include a paper discharge roller 71 and a backup roller 72, and may be configured to discharge the printing medium, after it has passed through the fixing unit 60, out of the body 10 of the image forming apparatus.

Figure 2:
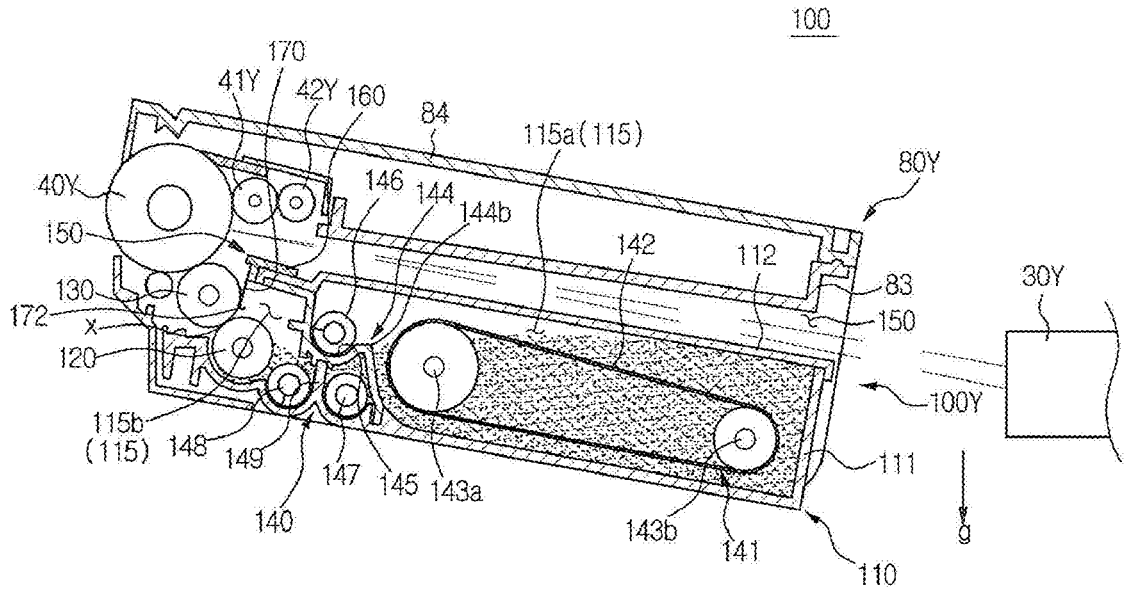
FIG. 2 is a sectional view illustrating a photoconductor, a developing unit, and a waste developer collecting unit in accordance with an embodiment.
Figure 3:
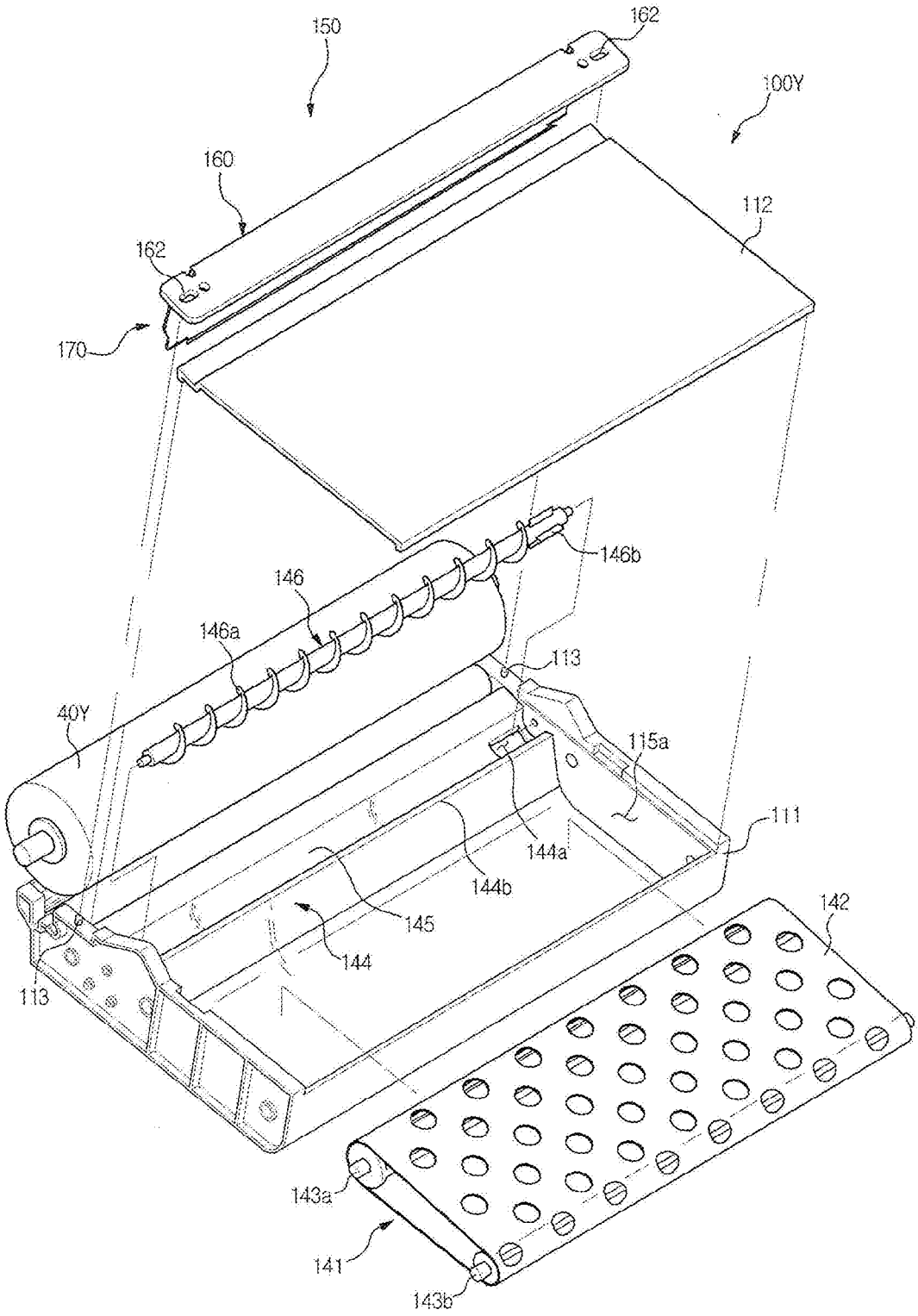
FIG. 3 is a perspective view illustrating a photoconductor and developing unit in accordance with an embodiment.
Figure 4:
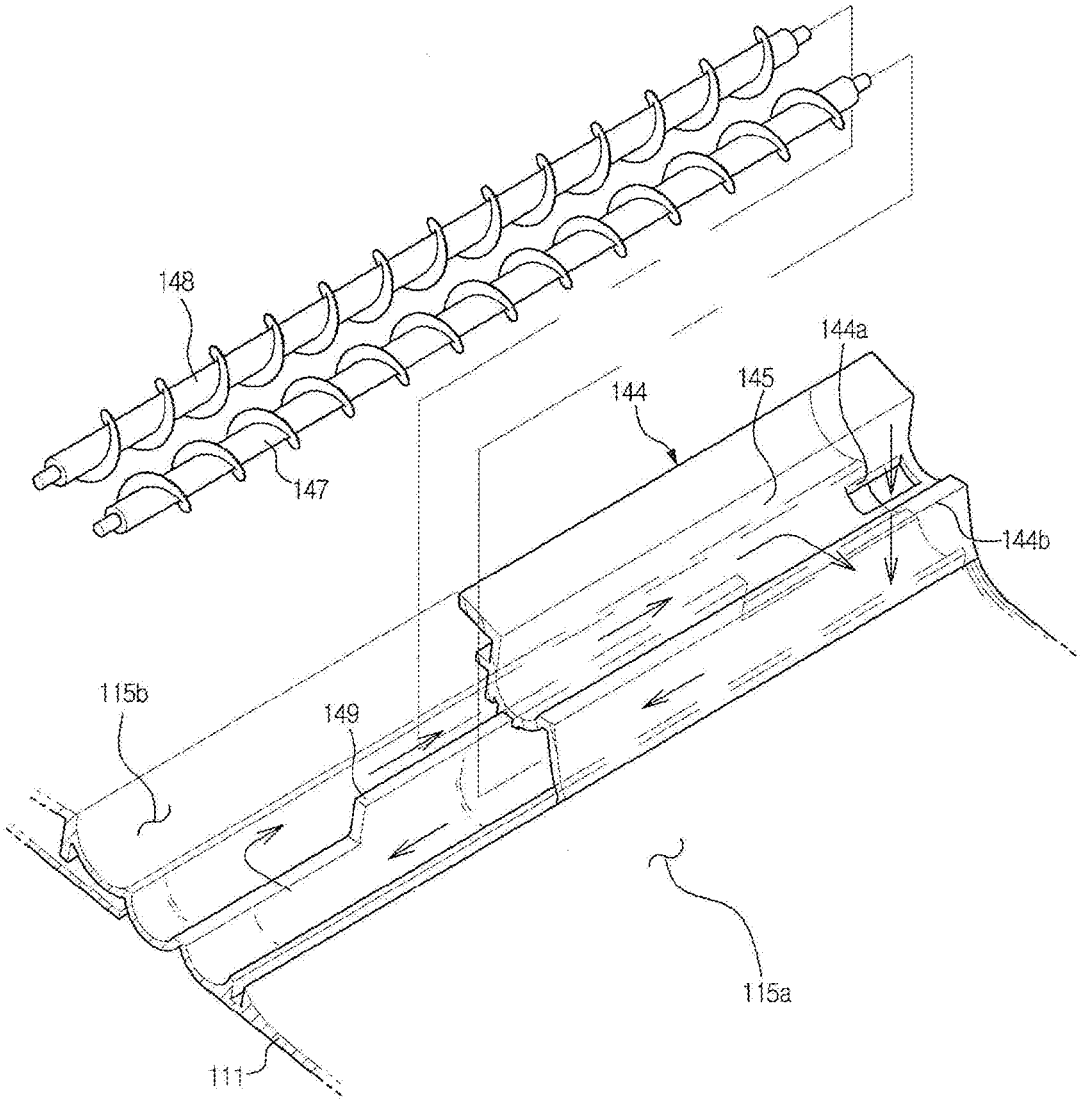
FIG. 4 is a view illustrating a developer delivery path in a developing unit in accordance with an embodiment.
Figure 5:
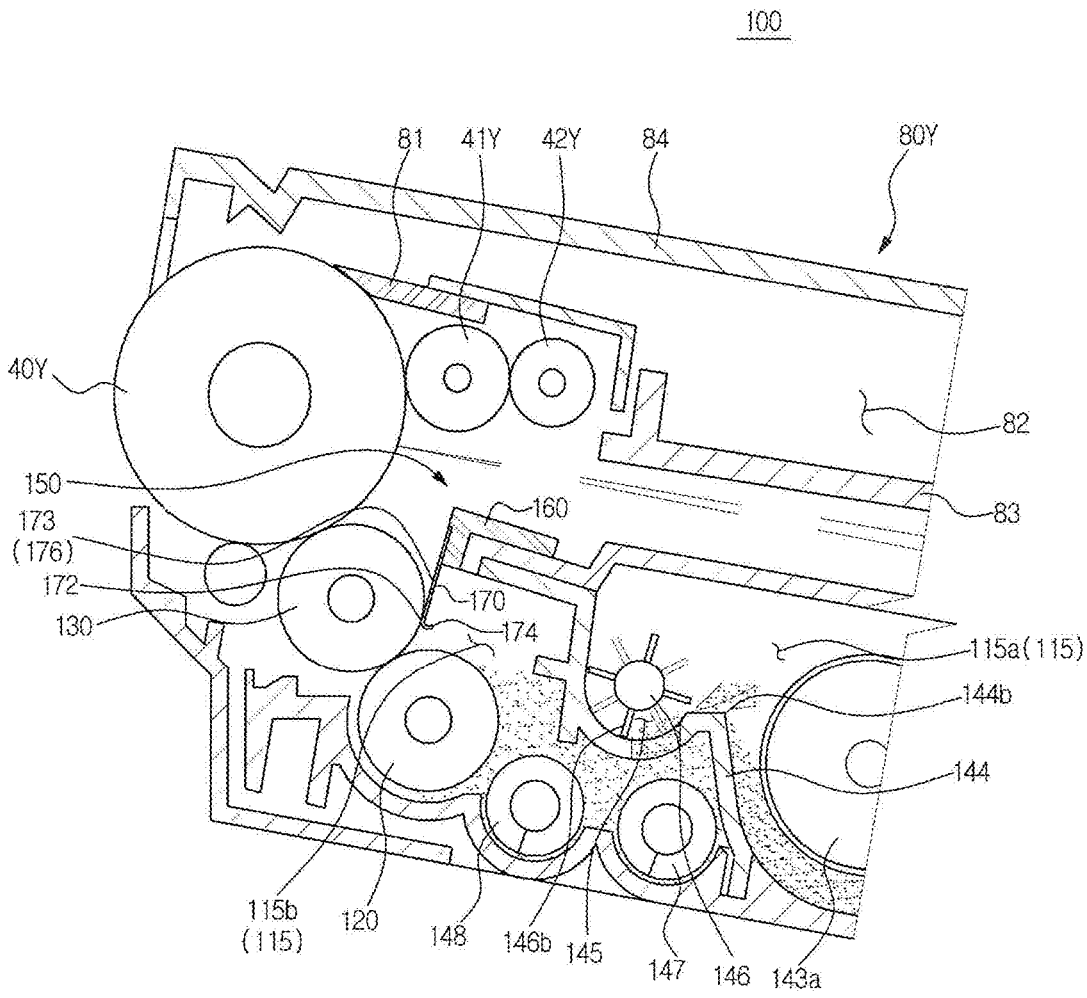
FIG. 5 is a view illustrating a return operation of a developer fed in a temporary storage portion of a partition in accordance with an embodiment.

FIG. 2 is a sectional view illustrating a photoconductor, a developing unit and a waste developer collecting unit in accordance with an embodiment. FIG. 3 is a perspective view illustrating a photoconductor and a developing unit in accordance with an embodiment. FIG. 4 is a view illustrating a developer delivery path in a developing unit in accordance with an embodiment. FIG. 5 is a view illustrating a return operation of developer fed in a temporary storage portion of a partition in accordance with an embodiment, which may be implemented when, for example, a sufficient amount of developer is fed into a second developer receiving chamber of the developing unit.

Although the developing unit 100Y in which a yellow (Y) developer is received will be described hereinafter by way of example, the following description is applicable to the other three developing units 100M, 100C and 100K as well.

As shown in FIG. 2, the image forming apparatus may include a developing device assembly 100 including the photoconductor 40Y, a waste developer collecting unit 80Y and the developing unit 100Y.

The waste developer collecting unit 80Y may be configured to collect developer remaining on the photoconductor 40Y to prevent or reduce the amount of developer being transferred onto the printing medium S. The waste developer collecting unit 80Y may include a cleaning blade 81 (see FIG. 5) configured to scrape the waste developer remaining on the surface of the photoconductor 40Y and a waste developer receiving chamber 82 (see FIG. 5) in which the collected waste developer is received. Reference numerals 83 and 84 indicate frames defining the waste developer receiving chamber 82.

The developing unit 100Y may include a frame 110 in which a developer receiving chamber 115 is defined, a feed device 120 and a developing device 130 each rotatably provided in the frame 110, a developer delivery part 140 configured to deliver the developer received in the developer receiving chamber 115 to the feed device 120 and a regulating device 150 configured to regulate the layer of the developer attached to the developing device 130.

The frame 110 may define an exterior of the developing unit 100Y, and may protect constituent elements provided therein. As shown in FIGS. 2 and 3, the frame 110 may include a base frame 111 in the form of a container filled with the developer and a cover 112 to cover the top of the base frame 111. Rotating members, such as the developing device 130 and the feed device 120, may be rotatably supported on the base frame 111.

Figure 7A:
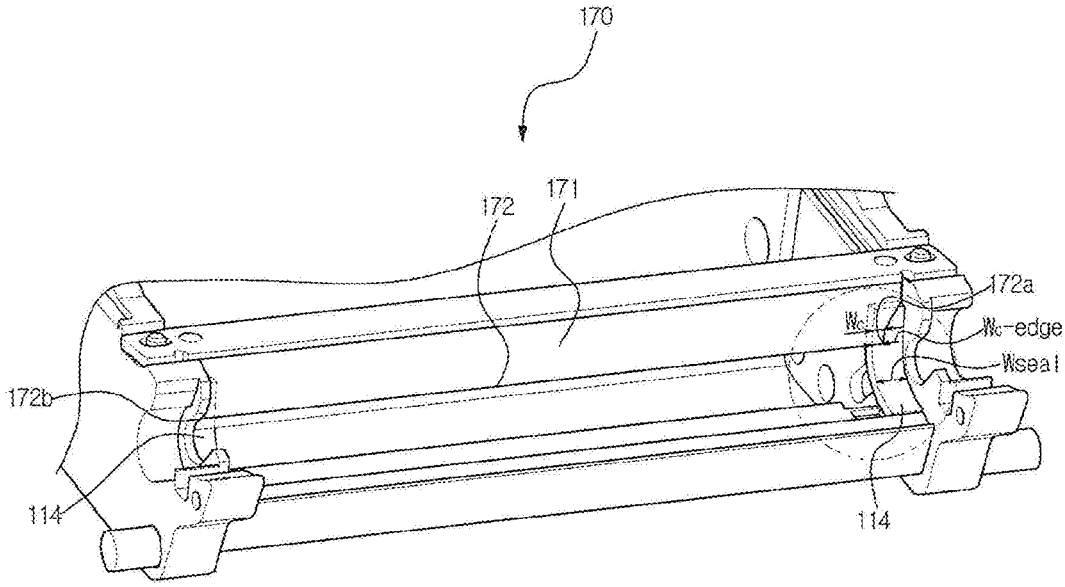
FIGS. 7A and 7B are perspective views illustrating a part of a developing unit provided with a regulating device in accordance with an embodiment.

Sealing members 114 may be provided at left and right side surfaces of the frame opposite the developing device 130 to prevent leakage of the developer from the frame 110 (see FIG. 7A). The sealing members 114 may have an extension rate of 20% or more, sufficient to come into close contact with an outer peripheral surface of the developing device. The sealing members 114, according to an embodiment, may be formed by stacking Tefron felt and Poron materials, and may be attached to the base frame 111 using double-sided tape, for example. However, the configuration and attachment of the sealing members 114 are not limited to the above examples, and various alterations are also possible.

The developer stored in the developer receiving chamber 115 may be fed to the photoconductor 40Y by the feed device 120 and the developing device 130. The feed device 120 and the developing device 130 may be of a cylindrical roller type in which a conductive shaft is centrally located and a conductive rubber roller portion surrounds the periphery of the conductive shaft. The shape of the feed device 120 and the developing device 130 is not however limited to the roller shape, and a belt type, brush type, and other configurations are also applicable.

The feed device 120 and the developing device 130, according to an embodiment, may be rotatably arranged to oppose each other with a nip region x defined therebetween. As the feed device 120 and the developing device 130 are rotated in opposite directions, the developer in the nip region x may be charged with a frictional charging force, and may be delivered from the feed device 120 to the developing device 130. In addition or alternate to the frictional charging force, an appropriate DC power may be applied to the feed device 120 and developing device 130 to deliver the developer by electrical force. If DC power is utilized, an absolute value of power applied to the developing device 130 is, according to an embodiment, less than an absolute value of power applied to the feeding device 120, for the purpose of easier delivery of the developer.

As shown in FIGS. 2 to 5, the developer delivery part 140 may include a belt device 141, a partition 144 to divide the developer receiving chamber 115 into a first developer receiving chamber 115*a* and a second developer receiving chamber 115*b*, a feed auger 146 provided at one side of the partition 144, and circulating augers 147 and 148 provided at the other side of the partition 144.

The belt device 141 may include a delivery belt 142 and a pair of drive shafts 143*a* and 143*b* configured to drive the delivery belt 142. According to an embodiment, of the two drive shafts 143*a* and 143*b*, the center of the drive shaft 143*a* located closer to the feed auger 146 may be positioned lower than the rotating center of the feed auger 146 with respect to the direction of gravity. In addition, a rotator located on the drive shaft 143*a* closer to the feed auger 146 may have a larger rotating radius than a rotating radius of a rotator located on the drive shaft 143*b* located farther from the feed auger 146. Moreover, the drive shaft 143*a* closer to the feed auger 146 may be positioned higher than the drive shaft 143*b* farther from the feed auger 146 in the direction of gravity. This arrangement may advantageously enable efficient adjustment of a feed amount of the developer.

Conventionally, a plurality of agitators may be arranged substantially horizontally toward the feed device, to feed developer to the feed device. In a color image forming apparatus in which a plurality of developing units are substantially vertically stacked above one another, it may be necessary or desirable to reduce the height of each developing unit to reduce the overall height of the image forming apparatus, which is related with reduction in a rotating radius of the agitators within the developing unit. The smaller the rotating radius of the agitators, the smaller the rotating radius of the developer being delivered, and, consequently, the smaller the delivery span of the developer. In other words, the smaller the height of the developing unit, the smaller the rotating radius of the agitators, which may lead to a need for a sufficient number of agitators for efficient delivery of the developer. However, feeding the developer by way of a large number of agitators may apply stress to the developer. Further, an increased number of agitators may result in a complicated configuration including a complicated drive force transmission mechanism to drive the agitators. According to an embodiment, if the delivery belt is used to feed the developer, there is no need for a plurality of agitators. Even if the developing unit has a small height, the developing unit provides rotation of the pair of drive shafts, thus resulting in a simplified configuration. In addition to the elimination of the complicated driving force transmission mechanism, the use of the delivery belt according to an embodiment may also prevent or reduce unnecessary stress to the developer.

The partition 144 may include a developer temporary storage portion 145 surrounding the bottom of the feed auger 146, and an inlet 144*a* may be perforated in a side of the developer temporary storage portion 145.

The developer, delivered to the developer temporary storage portion 145 by the belt device 141, may enter into the second developer receiving chamber 115*b* through the inlet 144*a* by gravity. If the developer fed into the second developer receiving chamber 115*b* accumulates to or near the vicinity of the inlet 144*a*, the developer in the developer temporary storage portion 145 may no longer be fed into the second developer receiving chamber 115*b*, and may be returned to the belt device 141 by a return blade 146*b* of the feed auger 146. Accordingly, the developing unit 100Y is able to maintain an appropriate amount of the developer received in the second developer receiving chamber 115*b* without a separate sensor member. More specifically, if the developer in the second developer receiving chamber 115*b* accumulates to or near the vicinity of the inlet 144*a*, the developer is returned to the belt device 141 rather than being further fed to the inlet 144*a*, whereby the amount of the developer received in the second developer receiving chamber 115*b* may be maintained at a predetermined level without the provision of a separate sensor member. To prevent the developer fed into the second developer receiving chamber 115*b* from accumulating above the nip region x between the feed device 120 and the developing device 130, according to an embodiment, the inlet 144*a* of the partition 144 may be located lower than the nip region x between the feed device 120 and the developing device 130 in the direction of gravity (see FIGS. 2 and 3).

The inlet 144*a* may have a rectangular or elliptical shape, for example, and may be located close to a longitudinal distal end of the rotating feed auger 146. However, in an embodiment where the feed auger 146 is replaced by a mixing agitator or any other delivery member having a feed function, one inlet 144*a* may be perforated, or the inlet 144*a* may take the form of a longitudinally extending slit. Alternatively, a configuration in which a plurality of slits is longitudinally spaced apart from one another may be utilized.

Also, to prevent an excessive amount of the developer from being fed to the developer temporary storage portion 145, an end 144*b* of the developer temporary storage portion 145 toward the belt device 141 may be positioned lower than the rotating center of the feed auger 146 (see FIG. 2).

In the developing unit of the present embodiments, the partition achieves sequential feed and consumption of the developer, resulting in uniform print quality and effective use of the developer. The partition 144 is able not only to prevent the developer, which may be deteriorated by peripheral pressure and temperature around the developing device 130 and the feed device 120, from being returned into the first developer receiving chamber 115*a*, but also to enable sequential consumption of the developer around the developing device 130 and the feed device 120, thereby providing uniform or near uniform print quality. This may also prevent high-quality developer from being mixed with the deteriorated developer and becoming ineffective, resulting in enhanced use efficiency of the developer.

The feed auger 146 may include a spiral axial-delivery blade 146*a* and a radial-delivery blade 146*b*. The spiral axial-delivery blade 146*a* may be configured to generate axial delivery force to deliver the developer, fed to the developer temporary storage portion 145, to the inlet 144*a* perforated in a side of the partition 144. The radial-delivery blade 146*b* may be configured to generate radial delivery force to return a part of the developer having not been introduced into the inlet 144*a* to the belt device 141.

The developer, fed into the second developer receiving chamber 115*b* through the inlet 144*a*, may be circulated by circulating augers 147 and 148 with a circulating partition wall 149 interposed therebetween.

In addition to the auger type elements, such as the feed auger 146 and circulating augers 147 and 148, any other developer feed member, developer agitating member and developing mixing member may also be utilized. Peripheral configurations may be changed slightly according to the shapes of the respective members.

A shield member (not shown) configured to shield the inlet 144*a* in an initial state of the developing unit 100Y may be provided. The shield member may take the form of a film to allow a user to pull and remove the film or may be configured to open or close the inlet 144*a* in linkage with the surrounding rotating device (for example, the feed auger or circulating auger). If necessary or desirable, the shield member may be provided with an elastic device (not shown) to enable an elastic opening or closing operation and with a guide member (not shown) to guide movement of the shield member.

Figure 6A:
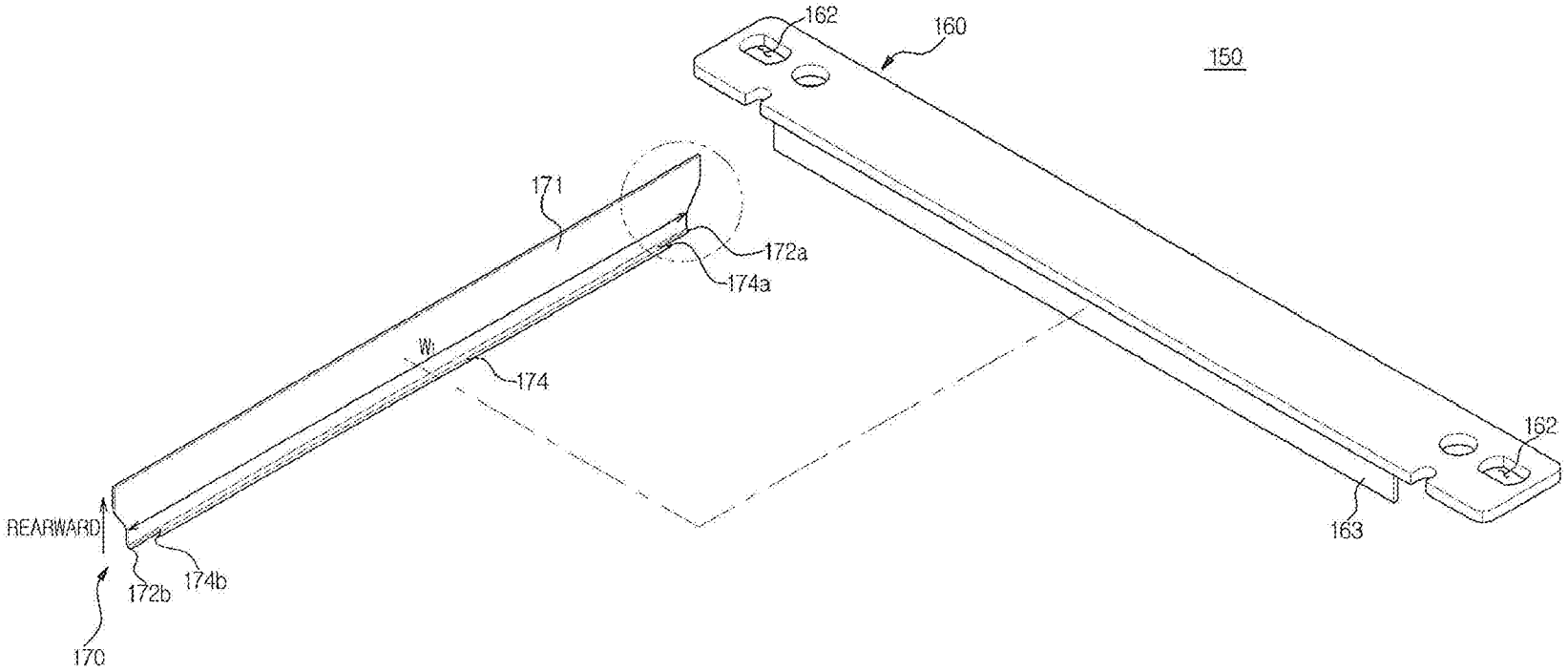
FIGS. 6A, 6B and 6C are perspective views illustrating a regulating device in accordance with an embodiment.
Figure 6B:
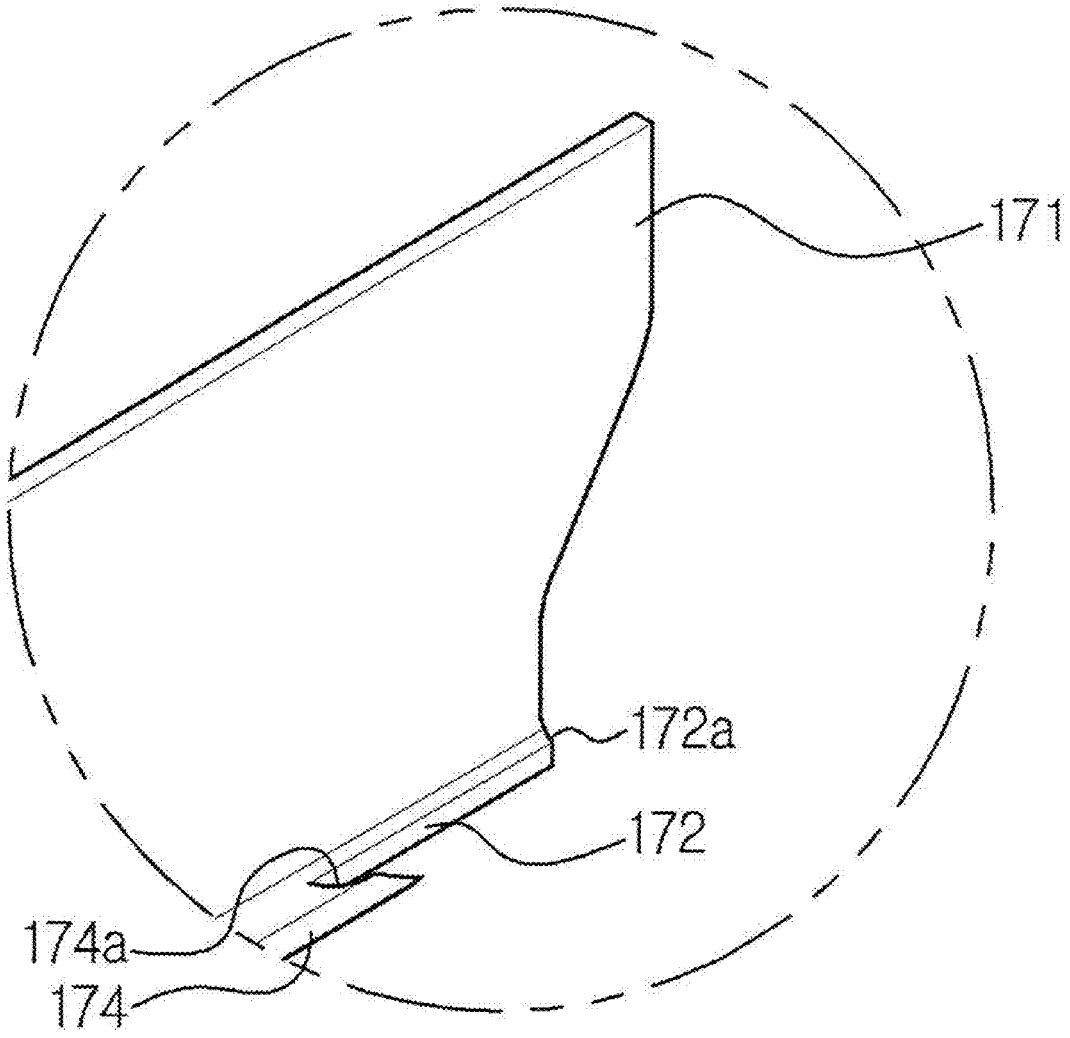
Figure 6C:
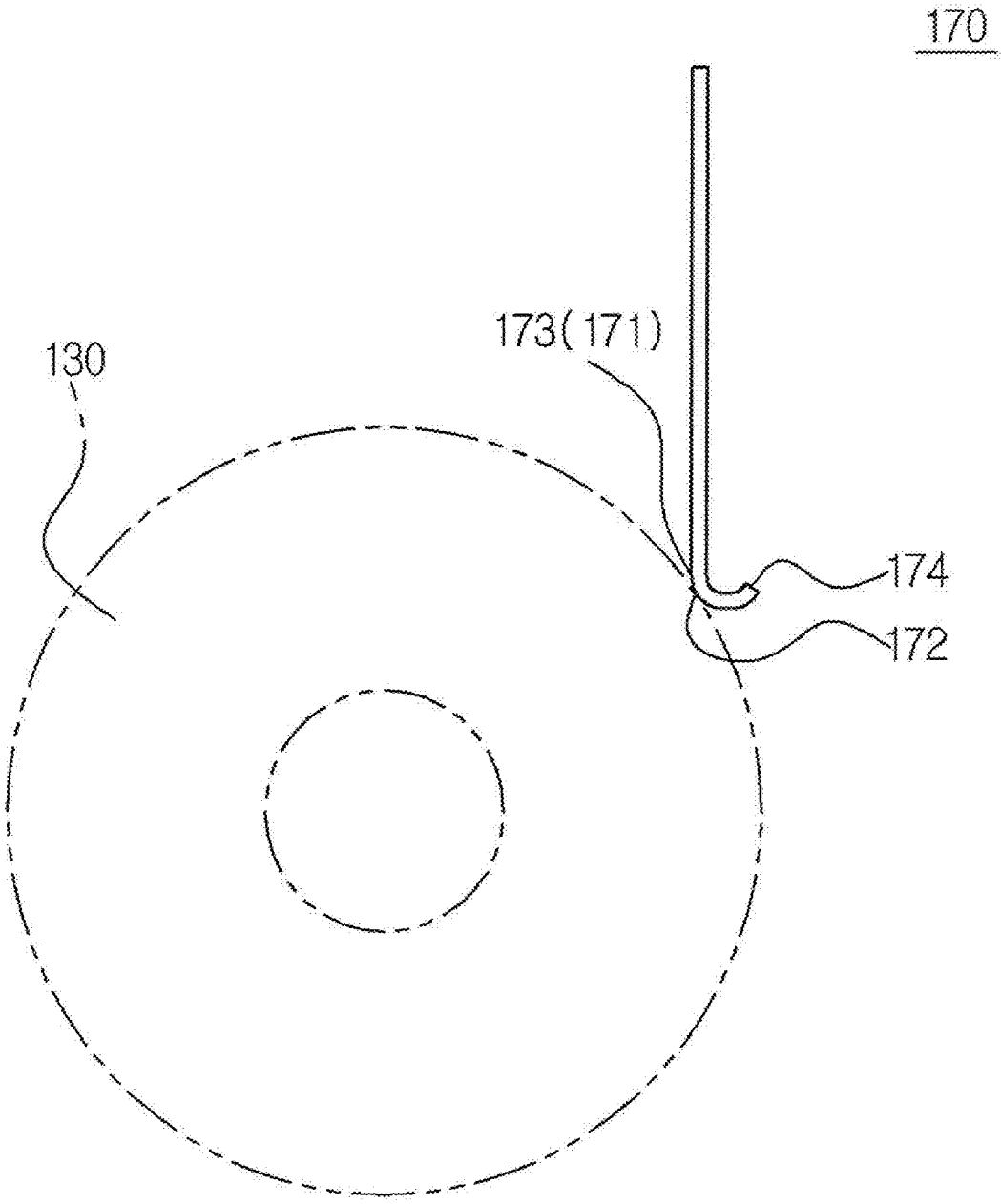
Figure 7B:
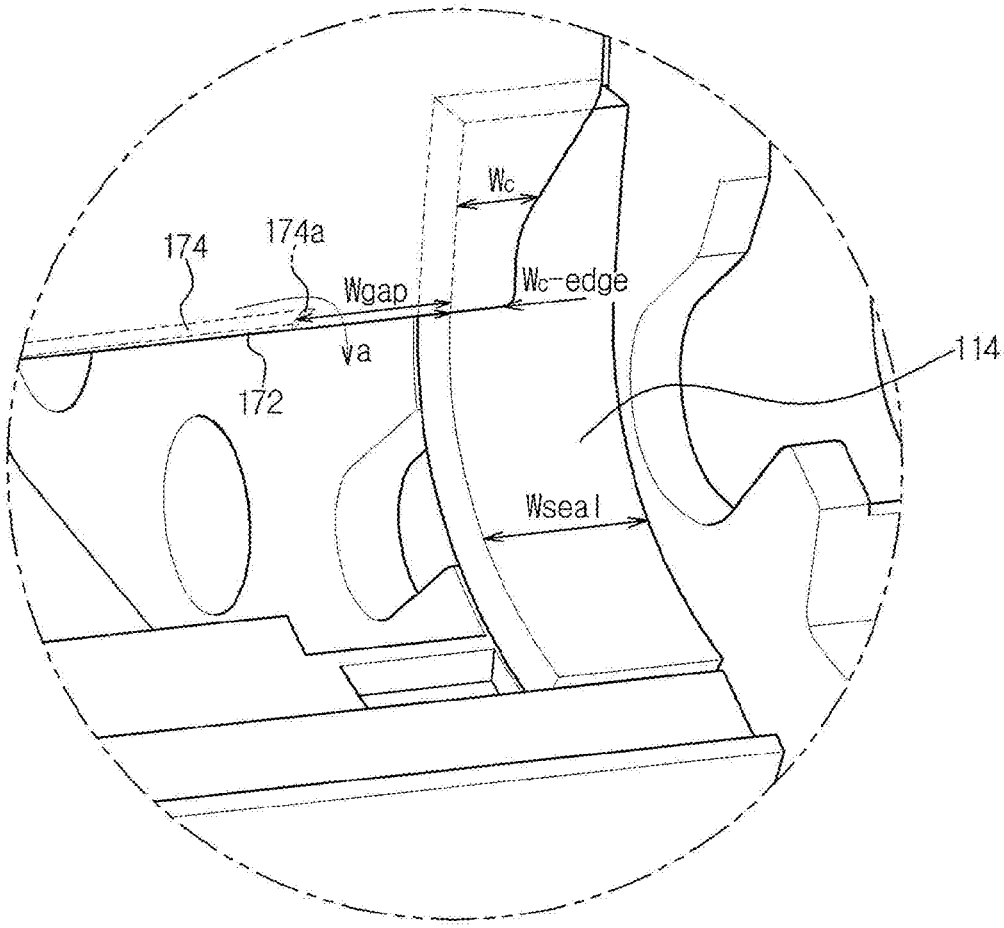

FIGS. 6A, 6B and 6C are perspective views illustrating the regulating device in accordance with an embodiment. FIG. 6B is an enlarged view of the circled portion of FIG. 6A. FIG. 6C is a side view of a regulating member in accordance with an embodiment. FIGS. 7A and 7B are perspective views illustrating a part of the developing unit provided with the regulating device in accordance with an embodiment.

As shown in FIGS. 6A. 6B and 6C, the regulating device 150 may include a supporting member 160 connected to the frame 110 and a regulating member 170 fixedly coupled to and supported by the supporting member 160.

The supporting member 160 may have fixing holes 162 perforated in opposite sides thereof to allow fixing protrusions 113 provided at opposite sides of the base frame 110 to be inserted, respectively, into the fixing holes 162. The regulating member 170 may be attached, for example, via laser point welding to a side surface 163 of the supporting member 160. An adhesive or any other welding method or type may be used to attach the regulating member 170 to the supporting member 160. To efficiently support the regulating member 170, the supporting member 160 may have a stronger rigidity than the regulating member 170, and may be made of a metallic material having a thickness of 1.5-2 mm or more, for example.

The regulating member 170, according to an embodiment, includes a bending portion 172, and may be gradually increased in width $W_1$ rearward from the bending portion 172. According to an embodiment, the regulating member 170 may include an extension portion 174 extending from the bending portion 172.

The regulating member 170 may have sufficient elasticity, and may take the form of a conductive plate containing, for example, one or more of Steel Use Stainless (SUS), phosphorus bronze, brass, polyimide, polyamide, or the like. The regulating member 170 may have, for example, a thickness from 0.05 mm to 1.5 mm and more effectively a thickness from 0.8 mm to 1.2 mm.

The bending portion 172 of the regulating member 170 may have a bending angle from about 80 degrees to about 110 degrees, for example, and more effectively a bending angle of about 90 degrees. The bending portion 172 may be configured to apply a predetermined contact pressure, such as a linear pressure, to an outer peripheral surface of the developing device 130. Thereby, of the developer attached to the outer peripheral surface of the developing device 130, scraping some developer beyond a predetermined height may be possible, thus enabling regulation in the height of the developer layer. The bending portion 172 may further be configured to frictionally charge the developer with a predetermined polarity.

The extension portion 174 may have a length from about 1.5 mm to about 3 mm, for example, and more particularly of about 2 mm. The extension portion 174 may be configured to regulate the amount of the developer to be collected (rather than being attached to the developing device 130) and the feed pressure of the developer.

As shown in FIGS. 7A and 7B, both side ends 172*a* and 172*b* of the bending portion 172 in accordance with an embodiment may come into contact with the respective sealing members 114, and the width $W_1$ of the regulating member 170 may increase rearward from the bending portion 172. As the width $W_1$ of the regulating member 170 increases rearward from the bending portion 172, a contact width $W_c$ between either side of a rear surface of the regulating member 170 and the corresponding sealing member 114 may be gradually increased rearward from the bending portion 172. In this case, a contact width $W_{c\text{-}edge}$ between the regulating member 170 and the sealing member 114 at either side end 172*a* or 172*b* of the bending portion 172 may be equal to or less than half of the entire width $W_{seal}$ of the sealing member 114. The contact width $W_c$ between the regulating member 170 and the sealing member 114 may be gradually increased to be greater than half of the entire width $W_{seal}$ of the sealing member 114.

As shown in FIGS. 7A and 7B, in a state in which the regulating device 150 is mounted in the developing unit 100Y, both side ends 174*a* and 174*b* of the extension portion 174, in accordance with an embodiment, are spaced apart from the sealing members 114 by a predetermined distance. In an embodiment, both the side ends 174*a* and 174*b* of the extension portion 174 and the sealing members 114 may be spaced apart from each other by a distance from about two times or more to five times or less of the contact width $W_{c\text{-}edge}$ between the bending portion 172 and the sealing member 114. In other words, a distance $W_{gap}$ between both the side ends 174*a* and 174*b* of the extension portion 174 of the regulating member 170 and the sealing members 114 may be in the range of about two times to about five times of the contact width $W_{c\text{-}edge}$ between the bending portion 172 and the sealing member 114.

With this configuration, the developing unit 100Y may have enhanced or improved regulation performance of the regulating member 170. Specifically, since both sides of the regulating member 170, in accordance with the present embodiment, are cut such that the width $W_1$ of the regulating member 170 is gradually increased rearward from the bending portion 172, there is substantially no risk or little risk of the developer, which leaks from and is solidified between the regulating member 170 and the sealing member 114, pressing both the side ends of the regulating member 170 against the sealing members 114 and causing deformation of the regulating member 170. Even if a part of the developer leaks between the regulating member 170 and the sealing members 114, by virtue of a substantial width of the sealing members 114 provided between the side ends 172*a* and 172*b* of the bending portion 172 and the base frame 111, there is substantially no possibility or little possibility of the leaked developer being introduced between a front surface 173 (shown in FIG. 5) of the regulating member 170 and the developing device 130 and being solidified at the front surface 173 of the regulating member 170.

When both the side ends of the bending portion 172 come into contact with the sealing members 114 in accordance with an embodiment, the regulating member 170 may also function to assist the sealing members 114 to be stably attached to the base frame 111. Although the sealing member of conventional devices may be problematically rolled up as the developing device 130 is rotated from the bottom to the top of the sealing member, the sealing member 114 according to an embodiment is supported forward by the bending portion 172 of the regulating member 170 and thus the above-described problem may be substantially less likely. The contact width $W_{c\text{-}edge}$ between the bending portion of the regulating member 170 and the sealing member 114 may be appropriately selected in a range for stable attachment of the sealing member while preventing the leakage and solidification of the developer between the regulating member and the developing device. More particularly, the contact width $W_{c\text{-}edge}$ may be equal to or less than half of the entire width $W_1$ of the sealing member 114.

Furthermore, in the developing unit 100Y in accordance with an embodiment, a gap $W_{gap}$ between either side end 174*a* or 174*b*_of the extension portion 174 of the regulating member 170 and the sealing member 114 is about two times or more of the contact width $W_{c\text{-}edge}$ between the bending portion 172 and the sealing member 114. Once the developer is separated from the developing device 130 by the regulating member 170 and is moved toward opposite sides of the regulating member 170, the developer may be discharged through spaces defined between both the side ends 174*a* and 174*b* of the extension portion 174 and the sealing members 114, whereby leakage of the developer through the spaces between the regulating member 170 and the sealing members 114 may be effectively prevented or reduced. In FIG. 7B, reference letter "a" indicates a movement path of the developer having passed through the regulating member 170.

According to an embodiment, when a printing operation begins, the surfaces of the respective photoconductors 40Y, 40M, 40C and 40K are uniformly charged with a predetermined electric potential by the charging devices 41Y, 41M, 41C and 41K. As the light scanning units 30Y, 30M, 30C and 30K irradiate light corresponding to image signals, electrostatic latent images are formed on the uniformly charged surfaces of the respective photoconductors 40Y, 40M, 40C and 40K. The respective developing units 100Y, 100M, 100C and 100K attach the developer to the photoconductors 40Y, 40M, 40C and 40K on which the electrostatic latent images are formed, thereby forming visible images. After the transfer unit 50 transfers the visible images formed on the surfaces of the photoconductors 40Y, 40M, 40C and 40K to a medium, the fixing unit 60 fixes the transferred images to the medium, prior to finally discharging the medium out of the image forming apparatus.

In the above-described operation, the process to feed the developer stored in the respective developing units 100Y, 100M, 100C and 100K to the photoconductors 40Y, 40M, 40C and 40K is described based on the developing unit 100Y used to feed the Yellow (Y) developer by way of an example.

According to an embodiment, the developer stored in the first developer receiving chamber 115*a* is delivered upward in the first developer receiving chamber 115*a* by the belt device 141, thereby being fed to the developer temporary storage portion 145 defined in the partition 144. After the developer, fed to the developer temporary storage portion 145, is delivered to one side of the partition 144 by the axial-delivery blade 146*b* of the feed auger 146, the developer falls into the second developer receiving chamber 115*b* through the inlet 144*a* formed in one side of the developer temporary storage portion 145 by gravity. The fallen developer circulates by the circulating augers 147 and 148 with the circulating partition wall 149 interposed therebetween. With this circulation process, the developer is fed to the developing device 130 by way of the feed device 120 under the influence of frictional charging force. The developing device 130 attaches the developer to the surface of the photoconductor 40Y on which the electrostatic latent image is formed by the light scanning unit 30, thereby forming a visible image. In this case, the regulating device 150 provided in the developing unit 100Y allows an even height of the developer to be applied to the surface of the developing device 130.

Figure 8:
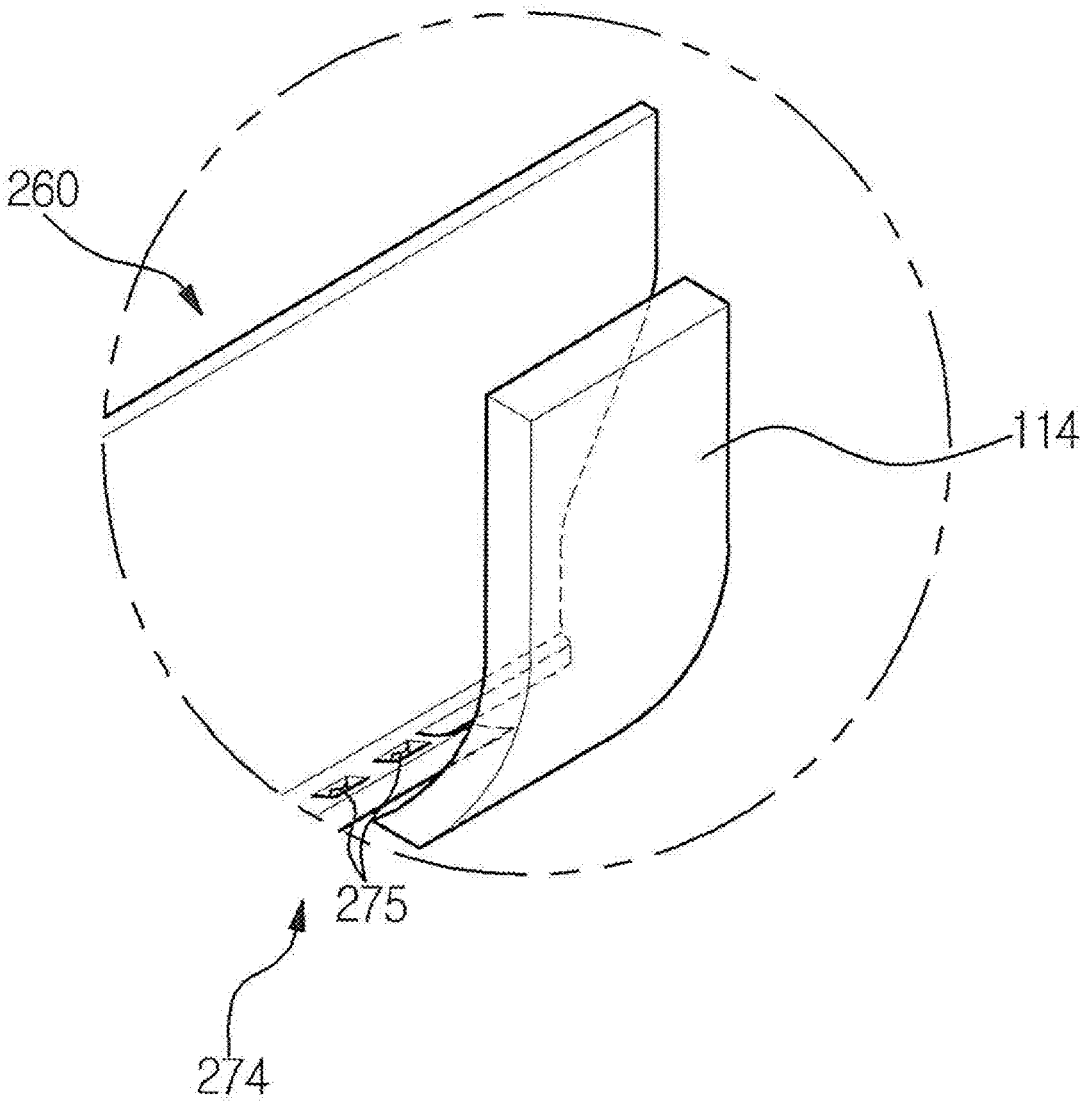
FIG. 8 is a perspective view illustrating a regulating device in accordance with an embodiment.

FIG. 8 is a perspective view illustrating a regulating device in accordance with an alternative embodiment.

According to an embodiment, at least one developer discharge hole 275 may be formed in either side of an extension portion 274 of a regulating member 260, i.e. in the extension portion 274 adjacent to the sealing member 114, allowing the developer moved to opposite sides of the regulating member 260 to be discharged through the developer discharge hole 275. This may cause the developer to apply a reduced pressure to the sealing member 114, preventing or reducing leakage of the developer between the regulating member and the sealing member.

The above-described embodiments are given only as examples, and other various alterations may be utilized. For example, the developer, such as toner, stored in the developer receiving chamber has no limit in delivery method thereof and may be delivered using various methods other than the above-described belt member and auger. Also, the regulating member may be altered into various shapes. Although the developing unit using a single-component developer has been described herein, the regulating member of the embodiments may naturally be applied to a developing unit using a binary component developer.

As is apparent from the above description, the embodiments provide a developing unit in which a regulating member configured to regulate a developer layer on a developing device is improved in regulation performance.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A developing unit usable in an image forming apparatus for developing an electrostatic latent image on a photoconductor, comprising:

a frame defining therein a developer receiving chamber for storing developer;

a developing roller rotatably provided in the frame and configured to feed the developer to the photoconductor;

a regulating member configured to regulate a developer layer attached to the developing roller, the regulating member having opposed right and left side edges, a supported portion extending between the right and left side edges and fixedly coupled with respect to the frame and a bent portion located opposite to the supported portion, an outer rounded region of the bent portion to contact an outer peripheral surface of the developing roller, and an extension portion extending from the bent portion such that left and right widthwise ends of the extension portion are disconnected from a respective side edge of the bent portion; and a first sealing member disposed on the frame such that at least a portion of one of the right and left side edges of the regulating member comes in contact with the first sealing member, wherein a first contact width between the regulating member and the first sealing member adjacent to the bent portion is less than a second contact width between the regulating member and the first sealing member measured a defined distance away from the bent portion toward the support portion.

2. The developing unit according to claim 1, further comprising:

a second sealing member disposed on the frame such that at least a portion of another one of the right and left side edge of the regulating member comes in contact with the second sealing member, wherein a third contact width between the regulating member and the second sealing member adjacent to the bent portion is less than a fourth contact width between the regulating member and the second sealing member measured a defined distance away from the bent portion toward the support portion.

3. The developing unit according to claim 1, wherein a first width of the regulating member measured between the opposed right and left side edges thereof adjacent to the supported portion is greater than a second width of the regulating member measured between the opposed right and left side edges thereof adjacent to the to the bent portion.

4. The developing unit according to claim 1, wherein the regulating member progressively increases in width starting adjacent to the bent portion until more than halfway toward the supported portion.

5. The developing unit according to claim 1, wherein the regulating member comprises a conductive plate that is elastically flexible in parallel relation to the bent portion.

6. The developing unit according to claim 1, wherein the photoconductor is rotatably provided in the frame.

7. The developing unit according to claim 1, wherein the first contact width between the regulating member and the sealing member is less than or equal to one half of an entire width of the sealing member.

8. The developing unit according to claim 7, wherein a contact width between the regulating member and the sealing member increases when a measuring location is moved away from the bent portion toward the support portion.

9. The developing unit according to claim 1, wherein the sealing members are disposed at locations on the frame such that each of the widthwise ends of the extension portion is spaced apart from a respective corresponding one of the sealing members by a distance.

10. The developing unit according to claim 9, wherein the distance by which each widthwise end of the extension portion is spaced apart from the respective corresponding one of the sealing members is about two times or more of a contact width between the bent portion and the sealing member.

11. The developing unit according to claim 1, further comprising: a supporting member fixed to the frame, wherein the regulating member is attached to the supporting member using an adhesive or via welding.

12. The developing unit according to claim 1, wherein the regulating member comprises at least one material selected from Steel Use Stainless (SUS), phosphorus bronze, brass, polyimide and polyamide.

13. The developing unit according to claim 1, wherein the regulating member has a thickness in the range of about 0.05 mm to about 1.5 mm.

14. A regulating device for regulating a developer layer on a developing roller of a developing unit, the developing unit including a frame in which a developer receiving chamber is defined, the developing roller rotatably provided in the frame for feeding developer to a photoconductor, the regulating device comprising:

a regulating member having opposed right and left side edges, and including a bent portion configured to come into a contact with an outer peripheral surface of the developing roller, and an extension portion extending from the bent portion such that left and right widthwise ends of the extension portion are disconnected from a respective side edge of the bent portion, wherein both ends of the bent portion contact the sealing members of the developing unit, and wherein a width of the regulating member measured between opposed right and left side edges thereof increases when a measuring location is moved in a direction away from the bent portion toward the supported portion.

15. The regulating device according to claim 14, wherein the developing unit includes sealing members disposed on the frame such that at least a portion of the right and left side edges of the regulating member comes in contact with the sealing members, wherein a contact width between the regulating member and the sealing members at either end of the bent portion is less than or equal to one half of the entire width of the sealing member.

16. The regulating device according to claim 15, wherein the contact width between the regulating member and the sealing member increases as moving rearward away from the bent portion so as to be greater than one half of the entire width of the sealing member at a location on the regulating member away from the bent portion.

17. A developing unit usable in an image forming apparatus for developing an electrostatic latent image on a photoconductor, comprising:

a developing roller configured to rotate about a rotational axis and having a surface for supporting thereon a layer of developer; and a regulating member having opposing right and left side edges, and including a bent portion in pressing relationship with the surface of the developing roller so as to regulate a thickness of the layer of developer being supported on the surface of the developing roller, and an extension portion extending from the bent portion such that left and right widthwise ends of the extension portion are disconnected from a respective side edge of the bent portion, wherein the regulating member has a variable width along a direction parallel to the rotational axis of the developing roller such that the bent portion has a first width while a portion of the regulating member away from the bent portion has a second width wider than the first width.

18. The developing unit of claim 17, wherein the extension portion has a third width narrower than the first width.

19. The developing unit of claim 18, further comprising: a sealing member disposed adjacent at least one of the widthwise ends of the regulating member, the sealing member being in contact with the at least one widthwise end of the regulating member and being spaced apart from a corresponding widthwise end of the extension portion.

* * * * *